US005349375A

United States Patent [19]

Bolash et al.

[11] Patent Number: 5,349,375

[45] Date of Patent: Sep. 20, 1994

[54] INK JET PRINTER DOT PLACEMENT COMPENSATION METHOD

[75] Inventors: John P. Bolash; Edmund H. James, III, both of Lexington; Randall D. Mayo, Georgetown, all of Ky.; Richard G. Zumbach, Davidson, N.C.

[73] Assignee: Lexmark International, Inc., Greenwich, Conn.

[21] Appl. No.: 870,449

[22] Filed: Apr. 16, 1992

[51] Int. Cl.[5] ..... B41J 2/07

[52] U.S. Cl. ..... 347/40; 400/279; 347/16

[58] Field of Search ..... 346/140 R, 1.1, 107 R, 346/76 PH, 150; 400/121, 279, 582; 358/296, 300, 301, 302, 303

[56] References Cited

U.S. PATENT DOCUMENTS

| | | | |
|---|---|---|---|
| 4,033,444 | 7/1977 | Beery | 197/1 R |
| 4,737,041 | 4/1988 | Nakayama | 400/121 |
| 4,953,995 | 9/1990 | Sims et al. | 400/121 |
| 4,972,270 | 11/1990 | Kurtin et al. | 358/296 |
| 5,070,345 | 12/1991 | Lahut et al. | 346/140 R X |

OTHER PUBLICATIONS

IBM Technical Disclosure Bulletin, vol. 31, No. 4, Sep. 1988, pp. 360–364.

*Primary Examiner*—Benjamin R. Fuller

*Assistant Examiner*—David Yockey

*Attorney, Agent, or Firm*—B. Franklin Griffin, Jr.

[57] ABSTRACT

In a printer having P+X printing elements for printing pixels with a vertical center-to-center spacing $R_1$ during a plurality of line scans, and a stepper motor for moving a record medium in increments $R_2$ where $R_2$ is greater than $R_1$, all points addressable printing is obtained by a combination of movement of the record medium orthogonal to the line scan direction and shifting address signals applied to the print elements. The stepper motor moves the record medium a distance $k_2R_2$ between successive line scans and address signals are applied to $(n+k_1)$th . . . $(n+k_1+P-1)$th print elements to cause a shift $k_1R_1$ such that the sum of the distance the record medium is moved before a line scan and the shift caused by the address signals during a scan is equal to $PR_1$ where P is the number of print elements active during the preceding line scan, or equal to any desired integral multiple of $R_1$ in other print modes. With a print head capable of printing pixels on 1/300 inch centers, and a stepper motor capable of moving the record medium in minimum increments of 1/150 inch, all points addressable printing with a pixel resolution of 1/300 inch is achieved with increased accuracy. This same arrangement also permits printing in the character mode with a line-to-line spacing of exactly 1/6 inch. In a second embodiment the line-to-line spacing differs from ½ inch by a distance that has minimal impact on print quality.

18 Claims, 4 Drawing Sheets

INK JET PRINTER DOT PLACEMENT COMPENSATION METHOD

FIELD OF THE INVENTION

This invention relates to printers and more particularly to a method whereby all points addressable printing is obtained with a pixel resolution $R_1$ although a stepper motor which moves the record medium in increments greater than the distance between pixel centers.

BACKGROUND OF THE INVENTION

A conventional printer, such as an ink jet printer, forms characters or graphic images by printing closely spaced pixels which overlap. The pixels are printed on a record medium as a print head carrying a plurality of ink jet nozzles is moved across the record medium in a line scan direction. Between line scans, a stepper motor moves the record medium in a direction transverse to the line scan direction. The number and position of the nozzles may vary but, generally speaking, the nozzles are capable of printing vertically aligned and overlapping pixels with a given center-to-center spacing or resolution. Print heads, such as that shown in U.S. Pat. No. 4,972,270 are capable of printing pixels on 1/300 inch centers. All points addressable printing using this head would be possible if one employed a stepper motor capable of moving the record medium in increments of 1/300 inch. Because of design problems and the cost of such motors it would be preferable to be able to use a stepper motor that moved the paper in larger increments.

Most printers are designed to provide either a one-sixth or one-eighth inch line-to-line spacing since these spacings were almost uniformly used in mechanical and electro-mechanical typewriters. To obtain exactly one-sixth or one-eighth inch line-to-line spacing using a stepper motor, the motor must be specially designed so that it advances the record medium 1/n inch in response to each stepping pulse where n is some multiple of the product of 6 and 8. For example, a stepper motor might be designed to advance the record medium one inch in response to 96 pulses. Such a motor would move the record medium ⅛ inch in response to 12 pulses or 1/6 inch in response to 16 pulses. When printing pixels on 1/300 inch centers, this arrangement does not allow advancing the record medium an arbitrary number of pixels. One approach is to select a step motor and gear train that increments the record medium 1/150 inch in response to each stepping pulse. In this case however, the 1/6 inch line increments require the motor to advance 25 steps for each line. Four phase step motors are less accurate when stepped an odd number of steps because of mechanical/magnetic tolerances. If an even number of steps are taken to advance the paper, these tolerances tend to cancel. A further improvement in accuracy is obtained if the number of steps taken to advance the paper is evenly divisible by 4. This is because the move will always start and finish on the same winding (or phase). Each different winding also has different magnetic tolerances which contribute to move inaccuracy. If the move starts and finishes on the same winding this inaccuracy is reduced.

The present invention permits use of a commercially available motor and a stepping increment greater than the desired pixel-to-pixel spacing to obtain all points addressable printing while at the same time permitting exact or nearly exact line-to-line spacing of 1/6 inch, where the move's total steps are evenly divisible by 4, or ⅛ inch, where the move's total number of steps are divisible by 4 90% of the time and an even number of steps 10% of the time, yielding improved accuracy.

SUMMARY OF THE INVENTION

An object of the present invention is to provide a novel method of operating a printer having a print head capable of printing pixels on a record medium with a vertical spacing between centers of $R_1$ so as to obtain all points addressable printing of pixels spaced by the distance $R_1$ even though a stepper motor which advances the record medium cannot move the record medium by distances less than $R_2$, $R_2$ being greater than $R_1$.

An object of the present invention is to provide a novel method of operating a printer to obtain a desired line-to-line spacing of printed pixels even though the stepper motor which advances the record medium is not capable of moving the record medium by a distance equal to the desired line-to-line spacing.

An object of the present invention is to provide a novel method of operating a printer having a print head capable of printing pixels on a record medium with a vertical spacing between pixels of $R_1$ so as to obtain all points addressable printing of pixels spaced by distance $R_1$ while the stepper motor which moves the record medium is advanced by multiples of a preferred integer m which yields improved motor move accuracy. Thus the record medium is advanced in multiples of $mR_2$ which is greater than $R_1$.

In accordance with the principles of the present invention, the above-stated objects are attained by energizing a stepper motor to advance a record medium by a distance which is approximately equal to the desired line-to-line spacing. On the line scan following advancement of the record medium, address signals for energizing the print elements are shifted before being applied to the print elements whereby pixels are printed with an offset such that the sum of the offset distance and the distance the record medium is moved is equal to the desired line-to-line spacing. For the general case, pulses are applied to the stepper motor to advance the record medium by a distance $k_2R_2$ where $k_2$ is an integer and $R_2$ is the minimum distance the stepper motor may advance the record medium. On the next line scan, address signals 1,2, . . . P are applied to the $(n+k_1)$th, $(n+k_1+1)$th, . . . $(n+k_1+P-1)$th print elements so that pixels are printed by the print elements at points shifted by a distance $k_1R_1$ relative to where the pixels would have been printed if the address signals were applied to the (n)th, (n+1)th, . . . (n+P−1)th print elements, $k_1$ and n being integers and $R_1$ being the distance between centers of pixels printed by two adjacent print elements. The steps of (1) moving the record medium by a distance $k_2R_2$ and (2) shifting the points where pixels are printed by $k_1R_1$ are repeatedly carried out with $k_1$ and $k_2$ varying such that $k_2R_2+k_1R_1=PR_1$ where P is the number of print elements which receive address signals during a given line scan of all points addressable printing.

Other objects, advantages and features of the invention, and the best mode contemplated for carrying it out, will become obvious from consideration of the following description and the accompanying drawing.

DETAILED DESCRIPTION OF THE INVENTION

Figure 1:
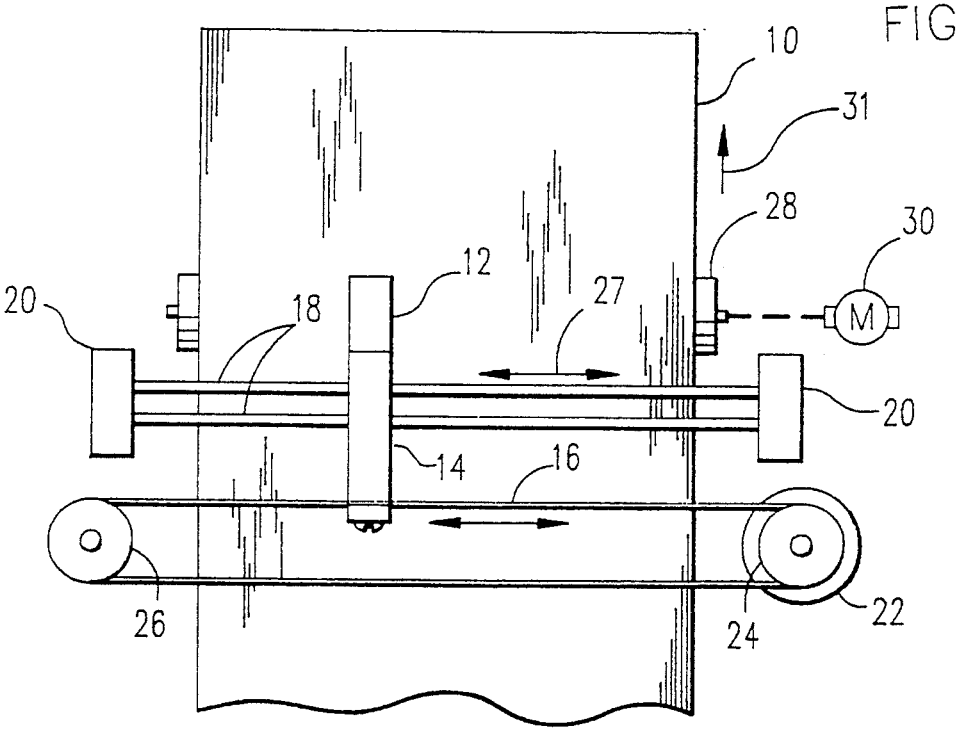
FIG. 1 schematically illustrates a printer in which the present invention may be practiced.

FIG. 1 schematically illustrates a conventional ink jet printer for printing graphically or alphanumerically on a record medium 10. The printer includes a print head 12 carried by a support 14 attached to a drive belt 16. The support 14 slides on two guide rails 18 mounted at each side of paper 10 in fixed supports 20. A reversible stepper motor 22 drives a first pulley 24. Drive belt 16 encircles pulley 24 and an idler pulley 26 so that as the motor 22 is selectively energized in first one direction then the other, the belt pulls support 14 along rails 18 so that the print head 12 is moved back and forth across the front of paper 10 along a horizontal axis as indicated by arrow 27.

A platen 28 is located behind paper 10 and rotates about an axis parallel to the path of movement of nozzle head 12. Platen 28 is driven by a stepping motor 30 and cooperates with pressure rollers (not shown) to advance the paper in the direction indicated by arrow 31 orthogonal to the direction of print head movement.

Figure 3A:
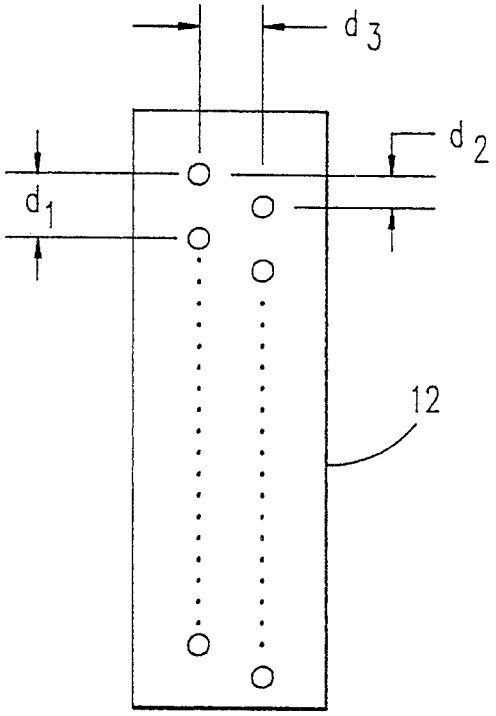
FIG. 3A illustrates a typical ink jet print head showing one arrangement of ink jet nozzles.

FIG. 3A illustrates a print head 12 of the prior art. The head has print elements in the form of two columns of ink jet nozzles designated the Odd column and the Even column. Each column includes 28 vertically aligned ink jet nozzles with a spacing $d_1$ of 1/150 inch between adjacent nozzles. The nozzles of the Even column are offset vertically with respect to the nozzles of the Odd column by a distance $d_2$ of 1/300 inch thus providing a vertical dot resolution of 300 dots per inch (DPI) as subsequently explained.

Figure 2:
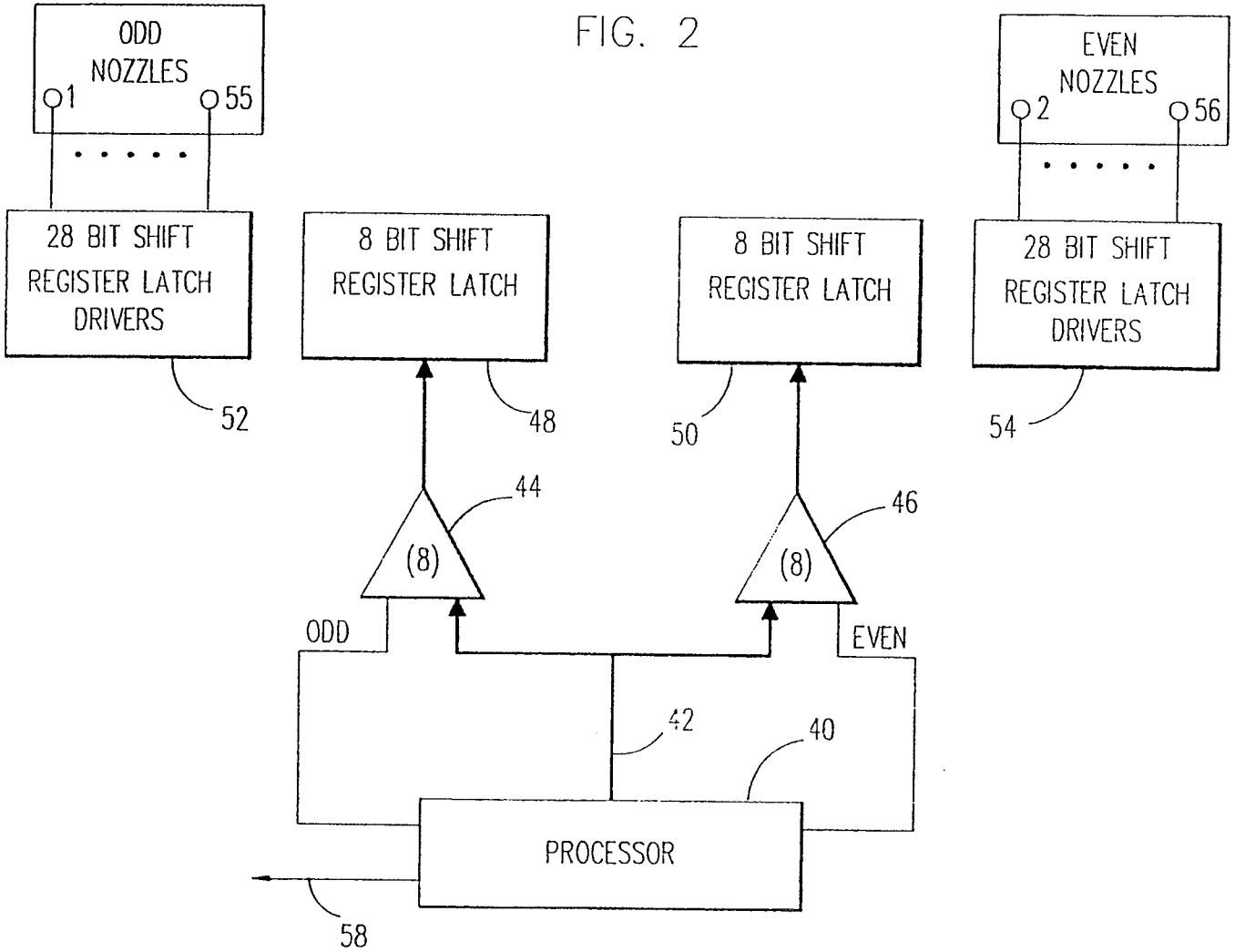
FIG. 2 is a block diagram of circuitry for applying address signals to print elements.

FIG. 2 schematically represents a control system for controlling actuation of the ink jet nozzles on head 12. The control system includes a microprocessor 40 connected by an 8-bit bus 42 to a set of eight Odd gates 44 and a set of eight Even gates 46. The outputs of gates 44 are connected to a parallel loaded eight-bit serial shift register latch 48 while the outputs of gates 46 are connected to a parallel loaded eight-bit serial shift register latch 50. The output stage of latch 48 is connected to the first stage of a twenty-eight bit serial shift register latch driver 52 and the output of latch 50 is connected to the first stage of a twenty-eight bit serial shift register latch driver 54. Each stage of latch driver 52 is connected to a print element mechanism (not shown) which causes ink to be ejected from a respective one of the odd numbered nozzles 1, 3 . . . 55 while each stage of latch driver 54 is similarly connected to the ink ejection mechanism for a respective one of the even numbered nozzles, 2, 4, . . . 56.

Printing is accomplished as follows. The microprocessor 40 produces an output signal EVEN to enable gates 46 and one data byte of eight bits is transferred from microprocessor 40 over bus 42 and through gates 46 to the latch 50. Next, the microprocessor 40 produces the signal ODD to enable gates 44 and transfers one byte of data over bus 42 and through gates 44 to the latch 48. The processor 40 produces control signals on various leads, collectively indicated at 58, to control the parallel loading of data bytes into latches 48 and 50 and the subsequent serial shifting of data through these latches into latch drivers 52 and 54.

Once latches 48 and 50 have been loaded with one byte of data, the latches are serially shifted into latch drivers 52 and 54, respectively. After the first bytes of data have been completely shifted into latch drivers 52 and 54, the process is repeated three times to load second, third and fourth bytes of data into latches 48 and 50 and shift them sequentially into latches 52 and 54 behind the first bytes.

After 3½ bytes have been loaded into each of the latch drivers 52 and 54, the system is ready to address, i.e. energize the ink ejector mechanisms. Note that since the Odd and Even columns of nozzles are spaced apart horizontally by a distance $d_3$ of 10/300 inch apart horizontally, the data loaded for one column (i.e. Odd) will be data for a print position 10/300 inch away from the other column (i.e. Even). This must be done so the odd and even nozzles can be energized by latch drivers 52 and 54 at the same instant to maximize thruput. The processor 40 generates a gating signal to gate the address signals from latch drivers 52 and 54 to the ink ejector mechanisms so that a pattern of dots or pixels is printed on the paper in accordance with the pattern of binary 0's and 1's stored in the latch drivers 52 and 54. Thus, the printing takes place simultaneously in two vertical columns corresponding to the Odd and Even columns of nozzles illustrated in FIG. 3A. For purposes of the present description it is assumed that a binary 1 causes a pixel to be printed while binary 0 does not.

Figure 3B:
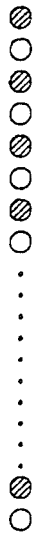
FIG. 3B illustrates a single vertical column of pixels printed by the nozzle of FIG. 3A.

The processor 40 then energizes the stepper motor 22 to move the nozzle head 12 horizontally 1/300 inch relative to the paper 10. This completes one print cycle. The next print cycle is initiated to again load 3½ bytes of data into each of the latches 52 and 54, and address and energize nozzles according to the data loaded. These cycles continue repeating. Once the 10th cycle occurs, the pixels printed by the trailing column of nozzles are now vertically aligned with any pixels printed by the leading column of nozzles during the first print cycle. This illustrated in FIG. 3B where the open pixels are those printed by the Even (leading) column of nozzles during the first cycle and the black shaded pixels are those printed by the Odd (trailing) column of nozzles on the tenth cycle. By repeating the print cycles and horizontally stepping the nozzle head 12 after every cycle it is therefore possible, during one horizontal scan across the record medium, to print vertically aligned columns of pixels, the pixels having a vertical center-to-center spacing of $R_1 = 1/300$ inch. Note that the Even and Odd columns swap their leading and trailing roles when the direction of printing is reversed.

It should be understood that the size of the pixels printed is such that a pixel printed by a nozzle in one row (Even or Odd) will overlap the pixels printed above and below it. The overlapping is not shown in the drawings to permit clearer illustration of the present invention. It should also be understood that the present invention is not limited to the specific control system shown in FIG. 2 nor the specific data flow described above. Data transfers may take place four or sixteen bits at a time rather than eight bits. Decoder drivers may be used in place of the shift register latch drivers 52 and 54.

The foregoing description assumes that all 56 nozzles are active for printing during one scan of the nozzle head 12 across the record medium. In actual practice, up to 50 nozzles are active during any scan. By moving the active 50 nozzles within the 56 available, the wear of the nozzles is distributed, leading to improved reliability. As used herein, an "active" nozzle is one which may be used to print pixels during a given scan of nozzle head 12 across record medium 10. An "inactive" nozzle is one which never prints pixels during a scan in which it is designated inactive. That is, it receives all zeros from latch driver 52 (or 54) during the scan.

Most printers in use today employ a paper feed step motor 30 which moves the record medium 10 vertically to provide a line-to-line spacing of 1/6 inch or ⅛ inch. Typically, the motor moves the record medium in the vertical direction in steps with 150 steps causing the record medium to move one inch. As mentioned previously, the motor operates better when moving an even number of stepping pulses than if moved an odd number of pulses. The motor operates best when the number of pulses in the move is evenly divisible by 4. If ⅛ inch and 1/6 inch paper moves can be made accomplishing the above, the system will operate at peak accuracy, yielding superior print quality especially in graphics. There may be advantages to having the paper feed system's minimum increment be 1/75 inches or more. This is especially true if higher paper feed speeds are desired. Although the preferred embodiment describes a system using a 1/150 inch paper feed increment per pulse, the idea is extendable to 1/75 inch and higher. More nozzles would be required in the print head in those cases.

Figures 4, 5:
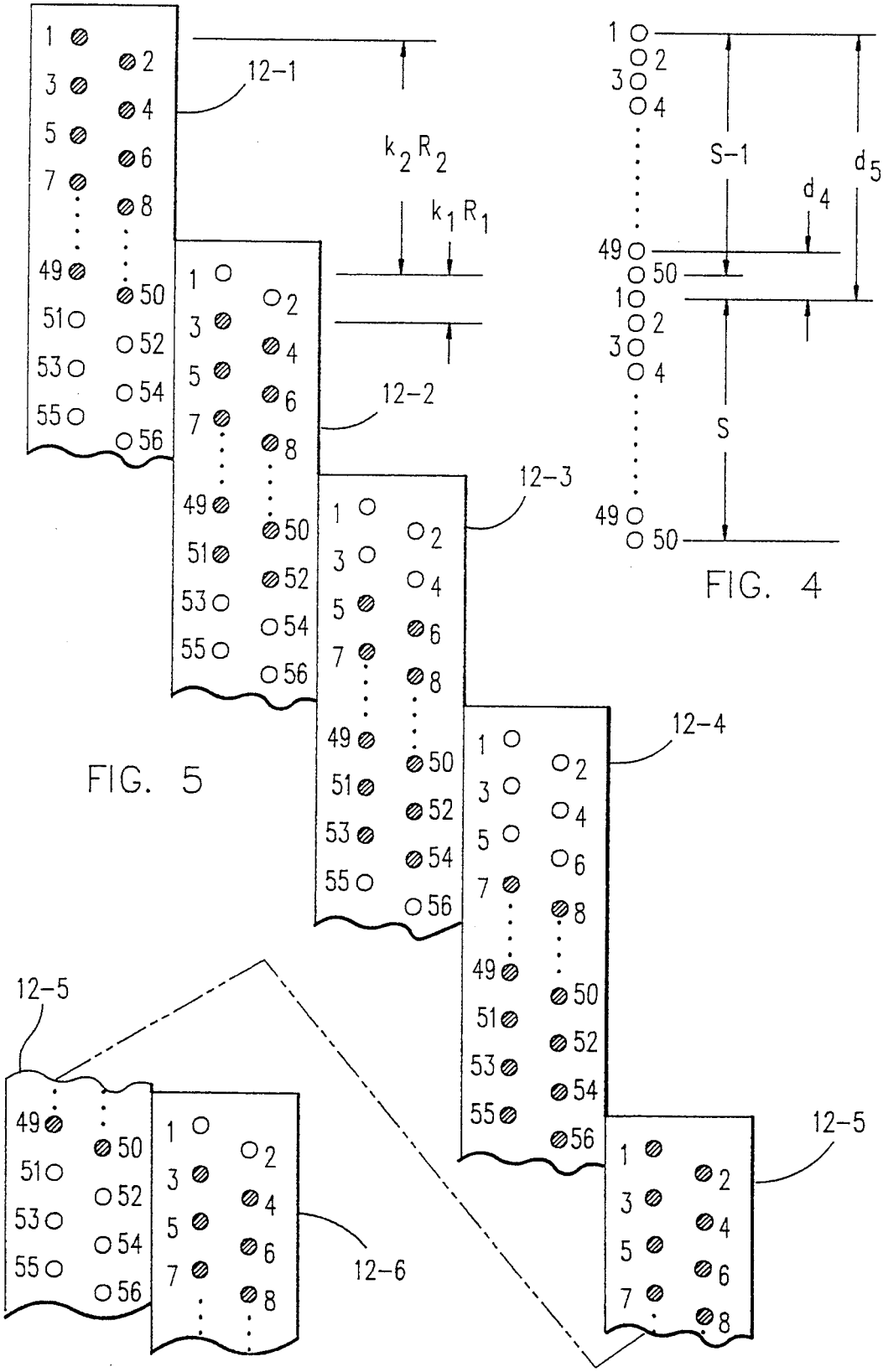
FIG. 4 is a diagram illustrating the problem solved by the present invention.
FIG. 5 is a diagram illustrating the printing of pixels in accordance with the present invention, the diagram being drawn for the specific case where the line-to-line spacing is 1/6 inch; and, FIG. 6 is a diagram similar to that of FIG. 5 but drawn for the specific case where the desired line-to-line spacing is ⅛ inch.

The problem with prior art devices may be understood by considering FIG. 4 wherein it is assumed that the nozzle head has only 50 nozzles and two line scans are to be printed. In order for the line formed by the printed pixels over the two scans S-1 and S to have uniform density, the spacing $d_4$ between the pixel 1 printed during scan S and the pixel 49 printed during scan S-1 must be the same as the vertical spacing between adjacent Odd nozzle heads, i.e. 1/150 inch. Thus the distance $d_5$ between pixel 1 printed during line scan S-1 and pixel 1 printed during line scan S is 25/150 or 1/6 inch. A motor as described above which advances the record medium 10 by 1/150 inch for each pulse it receives would require 25 stepping pulses, an odd number in order to advance the record medium 1/6 inch. Since the motor has inferior accuracy when the number of stepping pulses is odd, this inaccuracy will result in the media moving too far, causing "white lines" to appear in printed graphics or too little causing "dark lines".

FIG. 5 illustrates our novel method of obtaining 1/300 inch pixel resolution in all points addressable printing, using a motor which cannot move the record medium in steps smaller than 1/150 inch, with improved accuracy. In FIG. 5, the reference numerals 12-1 to 12-6 illustrate the horizontal line scan positions of nozzle head 12 relative to the record medium during six successive print line scans. The shaded nozzle positions indicate active nozzles. For purposes of illustration assume that the head 12 has P+X nozzles. P=50 nozzles may be active during any one line scan. On the first line scan, as the head 12-1 moves horizontally, any 50 nozzles n, n+1, . . . n+P−1 may be active. For purposes of illustration it is assumed that n=1 so that nozzles 1–50 are active. Between the first and second line scans, stepper motor 30 is energized with $k_2=12$ pairs of stepping pulses to advance the record medium 10 $k_2R_2=24/150$ inch. During the second line scan the data is shifted one bit position in processor 40 before it is applied to the shift register latches 48 and 50. This causes the data for nozzles 1, 3, 5, . . . 49 to be applied to nozzles 3, 5, 7, . . . 51, that is, a shift of one bit position of the data applied to the latches causes a shift of two pixel print positions. The data for nozzles 2, 4, 6, . . . 50 is applied instead to nozzles 4, 6, 8, . . . 52.

During the second line scan nozzles 3–52 are active. Since the record medium has been shifted by an amount equal to the distance between nozzles 1 and 49 ($k_2R_2=24/150$ inch) and the data has been shifted down $k_1=2$ pixel positions or the distance $k_1R_1=1/150$ inch, the top-most pixels printed during scan 2 by the top-most active odd nozzle (3) are $k_1R_1=1/150$ inch below the bottom-most odd nozzle (49) active during scan 1. Thus, the pixels printed during the two line scans have a uniform spacing of 1/300 inch.

If nozzles (n), (n+1), . . . (n+P−1) had been made active during the first line scan, it will be understood that during the second line scan nozzles ($n+k_1$), ($n+k_1+1$), . . . ($n+k_1+P-1$) would have been made active.

Between the second and third line scans another 12 pairs of pulses are again applied to motor 30 to advance the record medium 10 by a distance equal to the distance between nozzles 3 and 51. During the third line scan the processor 40 again shifts the data one bit position (two pixel print positions) relative to the previous scan so that it is applied to nozzles 5–54. Pixels are thus printed by nozzle 5 at positions which are 1/150 inch below the pixels printed by nozzle 51 during the second line scan.

Between the third and fourth line scans another 12 pairs of pulses are applied to motor 30 to advance the record medium by a distance equal to the distance between nozzles 5 and 53. During the fourth line scan the processor 40 again shifts the data one bit position relative to the previous scan so that it is applied to nozzles 7–56. Pixels are thus printed by nozzle 5 at positions which are 1/150 inch below the pixels printed by nozzle 53 during the third line scan.

Between the fourth and fifth line scans 14 pairs of pulses are applied to motor 30. This advances the record medium 10 by 28/150 inch, this being the distance between nozzles 1 and 57. During the fifth line scan processor 40 supplies the data without shift to nozzles 1–50. Therefore, on the fifth line scan nozzle 1 prints pixels which are 1/150 inch below the pixels printed by nozzle 55 during the fourth line scan.

From FIG. 5 it is evident that printing during the fifth line scan takes place in the same manner as during the first line scan hence after the stepper motor has been stepped from the fourth to the fifth scan line, the cycle of steps described above may be repeated. That is the stepper motor is pulsed 24 times between line scans and the nozzle data is shifted down one nozzle position (1/150 inch) during the succeeding line scan. After the line scan during which the data is applied with a shift of three nozzle positions, the stepper motor is pulsed 28 times and on the next line scan the data is applied to the nozzles without shift. The sequence is then repeated. Table I summarizes the operations described with reference to FIG. 5.

TABLE I

| Desired Media Position (inches) | Actual Media Position (inches) | Active Nozzles (dither) | Effective Pixel Position (inches) | Number of Motor Steps |
|---|---|---|---|---|
| 0 | 0 | 1-50 | 0 | 0 |
| 1/6 | 24/150 | 3-52 | 1/6 | 24 |
| $\frac{1}{3}$ | 48/150 | 5-54 | $\frac{1}{3}$ | 24 |
| $\frac{1}{2}$ | 72/150 | 7-56 | $\frac{1}{2}$ | 24 |
| $\frac{2}{3}$ | 100/150 | 1-50 | $\frac{2}{3}$ | 28 |
| 5/6 | 124/150 | 3-52 | 5/6 | 24 |
| 1 | 148/150 | 5-54 | 1 | 24 |

From the foregoing description it is evident that the present invention permits all points addressable printing with a center-to-center pixel spacing of exactly 1/300 inch even though the stepper motor for the record medium can advance the record medium in increments no less than 1/150 inch. Note the number of motor steps column in Table I. Each move is evenly divisible by 4 meaning the motor is operating at peak accuracy yielding improved vertical print registration.

The present method is also applicable in printers where the stepper motor moves the record medium approximately $\frac{1}{8}$ inch between scan lines but the positioning of pixels in this case is not exact. Table II summarizes the steps required.

TABLE II

| Desired Media Position (inches) | Actual Media Position (inches) | Active Nozzles (dither) | Effective Pixel Position (inches) | Number of Motor Steps |
|---|---|---|---|---|
| 0 | 0 | 1-50 | 0 | 0 |
| $\frac{1}{8}$ | 16/150 | 6-55 | $\frac{1}{8}$-1/600 | 16 |
| 2/8 | 36/150 | 4-53 | 2/8 | 20 |
| $\frac{3}{8}$ | 56/150 | 1-50 | $\frac{3}{8}$-1/600 | 20* |
| 4/8 | 72/150 | 7-56 | 4/8 | 16* |
| $\frac{5}{8}$ | 92/150 | 4-53 | $\frac{5}{8}$-1/600 | 20* |
| 6/8 | 112/150 | 2-51 | 6/8 | 20* |
| $\frac{7}{8}$ | 128/150 | 7-56 | $\frac{7}{8}$-1/600 | 16* |
| 8/8 | 148/150 | 5-54 | 8/8 | 20* |
| 9/8 | 168/150 | 2-51 | 9/8-1/600 | 20* |
| 10/8 | 186/150 | 4-53 | 10/8 | 18* |

*This sequence repeats to form $\frac{1}{8}$ pitch algorithm

Figure 6:
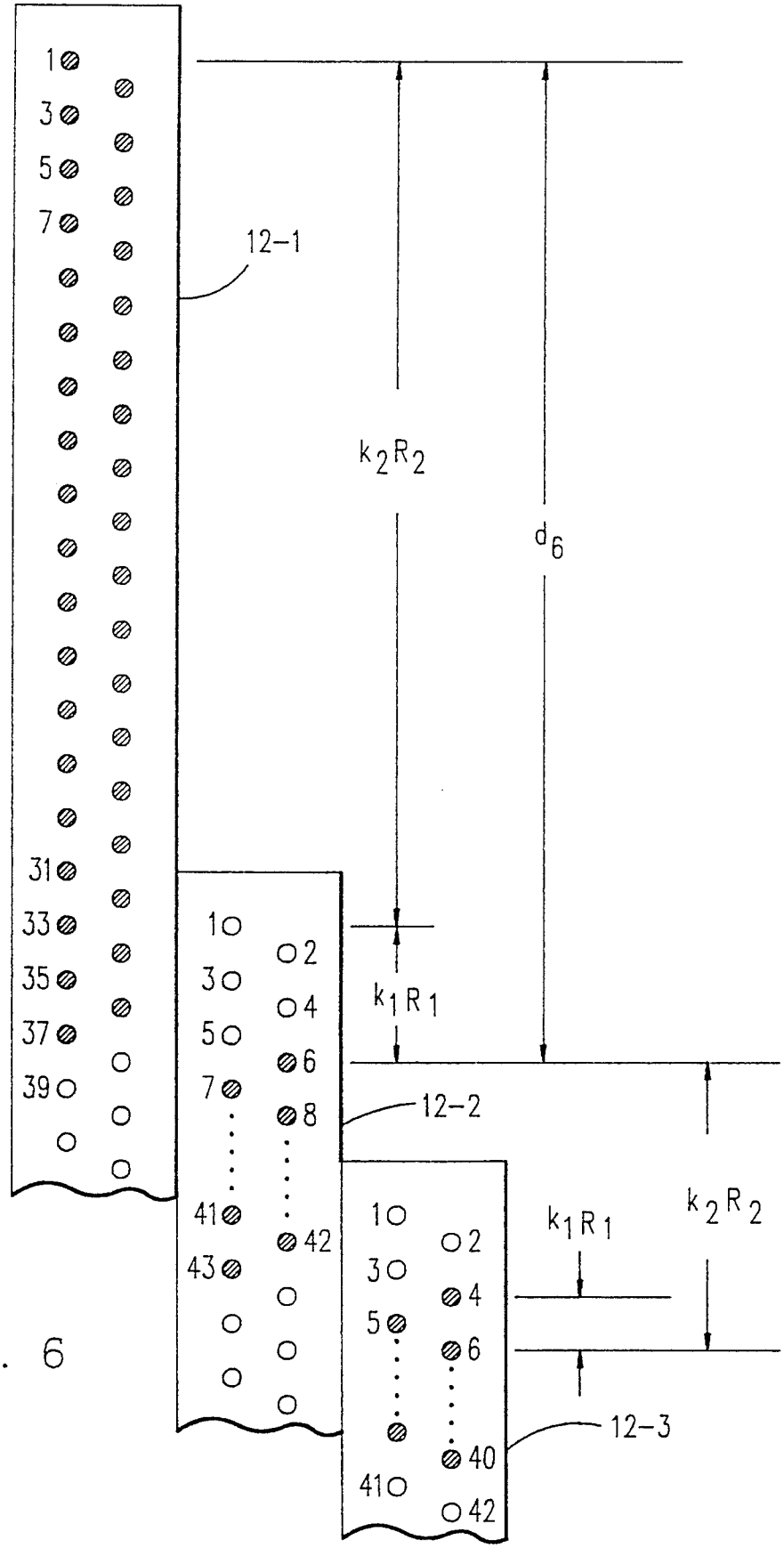

Inspection of Table II shows that the effective pixel positioning is exact on alternate line scans beginning with the first line scan, but is offset from the ideal pixel position by a distance of 1/600 inch on alternate line scans beginning with the second. Referring to FIG. 6, assume for purposes of illustration that of the active nozzles 1-50 only nozzles 1-37 are used for printing during the first line scan. Between the first and second line scans the stepper motor 30 is energized to advance the record medium 10 by $k_2R_2=16/150$ inch. On the second line scan nozzles 6-55 are active but assume that nozzles 6-43 are used for printing. Since the record has been advanced 16/150 inch and the data is shifted down by 5/300 inch, the vertical distance between nozzles 1 and 6, the pixels printed by nozzle 6 during the second line scan are vertically displaced $d_6=74/600$ inch from the pixels printed by nozzle 1 during the first line scan. This is only 1/600 inch less than the ideal displacement of $\frac{1}{8}$ inch, and is a distance so small as to be undiscernible by the human eye. However, the distance between pixels printed by nozzle 37 and 6 is exactly 1/300 inch.

Between the second and third line scans the stepper motor is energized with 20 pulses to advance the record medium by $RA_2=20/150$ inch. On the third line scan assume that of the active nozzles 4-53, nozzles 4-40 are used for printing. The pixels printed by nozzle 4 during the third line scan are exactly 2/8 inch below the pixels printed by nozzle 1 during the first line scan, this distance being the 16/150 inch record advance between the first and second line scans, plus the 5/300 inch shift downward of the nozzle data during the second line scan, plus the 24/150 inch record advance between the second and third line scans, minus the $k_1R_1=1/150$ inch upward shift of the address data during the third line scan relative to the address data during the second line scan.

The complete cycle of operations illustrated by Table II should be obvious from the foregoing description hence an explanation of each step is not believed necessary. It might be noted however that the conditions indicated on the last line of the table are exactly the same as on the third line, the only difference being that the record medium has been advanced one full inch. Thus, the operations represented by the fourth through eleventh lines are repeated once for each inch of record medium movement. Once again note the number of motor steps column of Table II. 90% of the moves are divisible by 4 yielding peak accuracy. The last move is an even number of steps (18) which yields better results than if an odd number of steps were required. In the prior art described previously 18.75 steps would be required. Since 0.75 steps cannot be achieved the motor is advanced 18 steps three times and 19 steps once. 18 step moves are not evenly divisible by 4 and 19 steps is odd. Thus, prior art devices cannot achieve the accuracy and vertical registration achieved by this method.

As stated above, fifty nozzles are active on any given line scan but all nozzles may not be used for printing. A different number of nozzles may be used for printing on different line scans. A useful sequence is to use 37 nozzles for printing on the first and alternate cycles and 38 nozzles on the second and succeeding alternate cycles. In the graphics mode this permits printing of vertical lines with a pixel resolution of 1/300 inch with no overlapping.

Although the invention has been described as used in a specific printer, it will be understood that the invention may be practiced in other printers having either different stepper motor or print head characteristics. The stepper motor need not advance the record medium in minimum increments of $R_2=1/150$ inch nor does the print head have to print pixels with center-to-center spacings of $R_1=1/300$ inch. All that is required is that $R_1$ and $R_2$ be such that there are two integer $k_1$ and $k_2$ whereby $k_1R_1+k_2R_2=PR_1$ where P is the number of active print elements during a line scan. The print head may have 1, 2 or more columns of print elements addressable in any sequence so long as they produce a uniform pixel spacing of $R_1$. The print head must have at least P+X print elements where X is equal to or greater than $k_1$. The print elements need not be ink jet nozzles but may comprise other types of elements for printing pixels.

The invention in which an exclusive property or privilege are claimed is defined as follows.

We claim:

1. A method of operating a printer mechanism having a print head for printing pixels on a record medium during a plurality of line scans as said print head is moved along an axis relative to said record medium, and a stepper motor for moving said record medium in a direction orthogonal to said axis, said print head having print elements 1,2, . . . P,(P+1) . . . (P+X) responsive to selectively applied address signals 1, 2, . . . P for selectively printing pixels at adjacent pixel positions aligned in the direction of record medium movement with a distance $R_1$ between centers of adjacent pixel positions, and said stepper motor being responsive to energizing pulses for moving said record medium by a minimum distance $R_2$ where $R_2$ is greater than $R_1$, said method comprising the steps of:

during a given one of said line scans, applying the address signals 1, 2, . . . P to said print elements (n), (n+1), . . . (n+P−1) whereby no more than P of said print elements print pixels during said given one of said line scans, n being a positive integer from 1 to X;

after said given one of said line scans, applying pulses to the stepper motor to move the record medium a distance $k_2R_2$; and, during another of the line scans following said movement of the record medium by said distance $k_2R_2$, applying the address signals 1, 2, . . . P to said print elements $(1+k_1)$,$(2+k_1)$ . . . $(P+k_1)$ whereby pixels are printed with a shift of $k_1R_1$ in a direction parallel to the direction the record medium is moved, where $k_2$, P and X are positive integers and $k_1$ is an integer no less than 0 and $k_1R_1+k_2R_2=PR_1$.

2. A method of operating a printer mechanism to obtain all points addressable printing of pixels over plural line scans with the center-to center distance between all pixel print positions in the director of record movement being exactly $R_1$, said printer mechanism having a print head for printing pixels on a record medium during a plurality of line scans as said print head is moved along an axis relative to said record medium, and a stepper motor for moving said record medium in a direction orthogonal to said axis, said print head having print elements 1,2, . . . P,(P+1) . . . (P+X) responsive to selectively applied address signals 1, 2, . . . P for selectively printing pixels at adjacent pixel positions aligned in the direction of record medium movement with a distance $R_1$ between centers of adjacent pixel positions, and said stepper motor being responsive to energizing pulses for moving said record medium by a minimum distance $R_2$ where $R_2$ is greater than $R_1$, said method comprising the following steps:

step 1) during each of said line scans, applying the address signals 1, 2, . . . P to said print elements $(1+k_1)$,$(2+k_1)$, . . . $(P+k_1)$ whereby pixels are printed with a shift distance of $k_1R_1$ relative to where pixels would have been printed if said signals had been applied to said print elements 1, 2, . . . P, respectively, the shift distance being in a direction parallel to the direction the record medium is moved, $k_1$ being an integer from 0 to X;

step 2) between successive ones of said line scans, applying a number of pulses to the stepper motor to move the record medium a distance $k_2R_2$, and, step 3) repeatedly carrying out step 1 and step 2 while applying said address signals to different ones of said print elements to vary said shift distance $k_1R_1$, and while varying the number of pulses applied to said stepper motor so that a sum of the distance $k_2R_2$ that the record medium is moved when a given step 2 is carried out and the shift distance $k_1R_1$ that the pixels are printed during a step 1 next succeeding said given step 2 is equal to $PR_1$, $k_2$, P and X being positive integers.

3. The method as claimed in claim 2 wherein $k_1$, on succeeding executions of step 1, has cyclically repeating values of 0,2,4,6,0 . . . during successive ones of said line scans.

4. The method as claimed in claim 2 wherein $PR_1=1/6$ inch.

5. The method as claimed in claim 2 wherein $R_1=1/300$ inch and $R_2=1/75$ inch.

6. The method as claimed in claim 2 wherein $R_1=1/300$ inch and $R_2=1/150$ inch.

7. The method as claimed in claim 2 wherein pulses are applied in pairs to said stepper motor, each of said pulses energizing said stepper motor to move said record medium 1/150 inch.

8. The method as claimed in claim 2 wherein said stepper motor has a number of phases and $k_2$ is a multiple of a positive integer m, where m represents a number of stepper motor pulses and is evenly divisible by a number representing the number of phases of said stepper motor.

9. A method of operating a printer mechanism having a print head for printing pixels on a record medium during a plurality of line scans as said print head is moved along an axis relative to said record medium, and a stepper motor for moving said record medium in a direction orthogonal to said axis, said print head having a plurality of print elements 1,2 . . . P,(P+1) . . . (P+X) responsive to selectively applied address signals 1, 2, . . . P for selectively printing pixels at adjacent pixel positions aligned in the direction of record medium movement with a distance $R_1$ between centers of adjacent pixel positions, and said stepper motor being responsive to energizing pulses for moving said record medium by a minimum distance $R_2$ where $R_2$ is greater than $R_1$, said method comprising the following steps:

step 1) during a given one of said line scans, applying the address signals 1, 2, . . . P to said print elements $(1+k_1)$, $(2+k_1)$ . . . $(P+k_1)$ whereby said print elements print pixels which are shifted by a shift distance $k_1R_1$ relative to where pixels would have been printed if said addressing signals had been applied to said print elements 1,2, . . . P, respectively, the shift distance being parallel to the direction the record medium is moved and $k_1$ being zero or a positive integer no greater than X;

step 2) between successive ones of said line scans, applying pulses to the stepper motor to move the record medium a distance $k_2R_2$; and, step 3) repeatedly executing step 1 and step 2 while applying said address signals to different ones of said print elements to vary said shift distance $k_1R_1$ and while varying the number of pulses applied to said stepper motor so that a sum of the distance $k_2R_2$ that the record medium is moved when step 2 is executed and the shift distance $k_1R_1$ that the pixels are printed during a next succeeding execution of step 1 differs from $PR_1$ by no more than one-half $R_1$, $k_2$, P and X being positive integers.

10. The method as claimed in claim 9 wherein $k_1$, on succeeding executions of step 1, has cyclically repeating values of 0,2,4,6,0, . . . during successive ones of said line scans.

11. The method as claimed in claim 9 wherein $PR_1=1/6$ inch.

12. The method as claimed in claim 9 wherein $R_1=1/300$ inch and $R_2=1/75$ inch.

13. The method as claimed in claim 12 wherein pulses are applied in pairs to said stepper motor, each of said pulses energizing said stepper motor to move said record medium 1/150 inch.

14. The method as claimed in claim 9 wherein $R_1=1/300$ inch and $R_2=1/150$ inch.

15. The method as claimed in claim 9 wherein $PR_1+k_1R_1$ is approximately $\frac{1}{8}$ inch.

16. The method as claimed in claim 9 wherein P and less than P address signals are applied to said print elements on a first and succeeding alternate ones of said line scans and the second and succeeding alternate ones of said line scans, respectively.

17. The method as claimed in claim 9 wherein $k_2$ is 8, 9 or 10.

18. The method as claimed in claim 9 wherein said stepper motor has a number of phases and $k_2$ is a multiple of a positive integer m, where m represents a number of stepper motor pulses and is evenly divisible by a number representing the number of phases of said stepper motor.

* * * * *